US011560244B2

(12) United States Patent
Beale

(10) Patent No.: US 11,560,244 B2
(45) Date of Patent: Jan. 24, 2023

(54) SOFT-SIDED BULK MATERIAL CONTAINERS WITH HOLD-INS

(71) Applicant: I.C.E. Packaging Company, LLC, Ambridge, PA (US)

(72) Inventor: Aldon E. Beale, Madisonville, TN (US)

(73) Assignee: I.C.E. Packaging Company, LLC, Moon Township, PA (US)

( * ) Notice: Subject to any disclaimer, the term of this patent is extended or adjusted under 35 U.S.C. 154(b) by 242 days.

(21) Appl. No.: 16/655,301

(22) Filed: Oct. 17, 2019

(65) Prior Publication Data

US 2020/0047923 A1 Feb. 13, 2020

Related U.S. Application Data

(60) Continuation of application No. 15/205,408, filed on Jul. 8, 2016, now abandoned, which is a division of application No. 13/288,935, filed on Nov. 3, 2011, now Pat. No. 9,394,081, application No. 16/655,301, filed on Oct. 17, 2019, which is a continuation of application No. 15/205,408, filed on Jul. 8, 2016, now abandoned, which is a continuation of application No. 13/670,122, filed on Nov. 6, 2012, now Pat. No. 9,388,022, which is a division of application No. 12/466,542, filed on May 15, 2009, now Pat. No. 9,359,175.

(60) Provisional application No. 61/409,759, filed on Nov. 3, 2010.

(51) Int. Cl.

| | |
|---|---|
| ***B65B 1/04*** | (2006.01) |
| ***B65D 88/16*** | (2006.01) |
| ***B65D 90/00*** | (2006.01) |
| ***B65D 33/02*** | (2006.01) |
| ***B65B 5/10*** | (2006.01) |
| ***B65B 61/20*** | (2006.01) |
| ***B66C 1/22*** | (2006.01) |

(52) U.S. Cl.

CPC ..... *B65B 1/04* (2013.01); *B65B 5/10* (2013.01); *B65B 61/20* (2013.01); *B65D 33/02* (2013.01); *B65D 88/16* (2013.01); *B65D 88/1612* (2013.01); *B65D 88/1631* (2013.01); *B65D 88/1668* (2013.01); *B65D 88/1681* (2013.01); *B65D 90/004* (2013.01); *B66C 1/226* (2013.01)

(58) Field of Classification Search

CPC ..... B60P 1/00; B65B 1/04; B65B 5/10; B65B 61/20; B65D 33/02

USPC ..... 414/405, 406, 407, 408, 685, 722, 724, 414/812

See application file for complete search history.

*Primary Examiner* — Saul Rodriguez
*Assistant Examiner* — Willie Berry, Jr.
(74) *Attorney, Agent, or Firm* — The Webb Law Firm

(57) ABSTRACT

A system, method and apparatus for transferring bulk material for transport, the method includes placing a first quantity of bulk material in a soft-sided bulk material container, extending a first hold-in across the container from a first side of the container to a second location, the second location being substantially toward a second side of the container, wherein the first hold-in is secured to the first side of the container, securing the first hold-in to the second location and placing a second quantity of bulk material in the container, the second quantity covering the first hold-in and securing the first hold-in to the second location with a weight of the second quantity of bulk material.

17 Claims, 20 Drawing Sheets

SOFT-SIDED BULK MATERIAL CONTAINERS WITH HOLD-INS

CROSS REFERENCE TO RELATED APPLICATIONS

This application is a continuation of and claims priority to and the benefit of U.S. patent application Ser. No. 15/205,408, filed on Jul. 8, 2016, which is incorporated herein by reference in its entirety and for all purposes. U.S. patent application Ser. No. 15/205,408 is a divisional of and claims priority to and the benefit of U.S. patent application Ser. No. 13/288,935 filed on Nov. 3, 2011, now U.S. Pat. No. 9,394,081, which is incorporated herein by reference in its entirety and for all purposes. U.S. patent application Ser. No. 13/288,935, now U.S. Pat. No. 9,394,081, claims priority to and the benefit of U.S. Provisional Patent Application No. 61/409,759, filed on Nov. 3, 2010, which is incorporated herein by reference in its entirety and for all purposes. U.S. patent application Ser. No. 15/205,408 is also a continuation of and claims priority and the benefit of U.S. patent application Ser. No. 13/670,122, filed on Nov. 6, 2012, now U.S. Pat. No. 9,388,022, which is incorporated herein by reference in its entirety and for all purposes. U.S. patent application Ser. No. 13/670,122, now U.S. Pat. No. 9,388,022, is a divisional of U.S. patent application Ser. No. 12/466,542, filed on May 15, 2009, now U.S. Pat. No. 9,359,175, which is incorporated herein by reference in its entirety and for all purposes.

BACKGROUND

The present invention relates generally to bulk material handling, and more particularly, to methods and systems for transferring, packaging, transporting, and otherwise handling bulk materials.

Typical processes for loading a typical soft-sided bulk material container with bulk material require supporting the soft-sided container using some sort of a support structure. FIG. 1 is a simplified schematic of a typical soft-sided container 100 supported in an external support structure. These structures are used in many forms and are of many different types, FIG. 1 showing an exemplary support structure 102 as a frame in which the container 100 is received. Such support structures are configured as structures in addition to the soft-sided container 100, and are in addition to equipment used for loading bulk materials 110 (shown in circle 112 and by arrow 114 as being loaded into the soft-sided container 100). The soft-sided container 100 is referred to as a "supported soft-sided container" when used with the support structure 102.

Exemplary bulk materials may include sand, minerals (e.g., salt and stone), agricultural materials (e.g., chemicals, fertilizers; bulk plastic pellets, whether new or recycled); waste materials (e.g., hazardous or non-hazardous), nuclear waste products loaded at controlled sites, landscaping or garden materials (e.g., compost, soil, bark) generally sold in small bags of manageable size, bulk grains (e.g., corn, feedstocks) and seeds. Such exemplary bulk materials may be mixed with other exemplary bulk materials, and each may be "wet", as by being mixed with a liquid, such as water. One common feature of all such bulk materials is that for transport, the bulk material has no inherent shape and assumes the shape of the container in which the bulk material is received for transport, and this applies whether or not the bulk material is mixed with a liquid.

The supported soft-sided container 100 can be filled by scooping and dumping multiple front end loader bucket loads, or loads from a bucket of similar loading equipment or conveyor system until the supported soft-sided container is filled. Then, the supported soft-sided container is closed to prevent spillage. Finally, the filled soft-sided container can be moved, generally without the support structure 102.

Generally, when such filled soft-sided container is moved (as by the vertical upward movement out of the support structure 102), the contained bulk material tends to move downwardly under the force of gravity and cause the soft-sided sides to move laterally, referred to as bulging.

FIG. 2 is a typical, rectangular soft-sided bulk material container 100. The typical, rectangular soft-sided bulk material container 100 is filled with bulk material and has lost its rectangular shape as the sides are slumping downward and spreading (bulging) outward. The bulging soft-sided sides assume a more curved shape rather than a more desired rectangular shape.

During the vertical upward movement of the filled container 100 out of the support structure 102, the bulging sides are urged laterally and are pressed against the support structure 102, risking damage to the sides. Also, when many such soft-sided containers 100 are adjacent to each other, the bulging soft-sided curved sides of the adjacent containers are next to each other. These sides of the containers cause the adjacent containers to occupy more lateral space than containers without the curved (bulging) sides as shown in FIG. 2. This is disadvantageous not only for storage of these containers, but for transport, e.g., in rigid intermodal units or flatbed trucks or trailers.

In the past, attempts have been made to prevent the soft-sided sides from bulging during the vertical upward movement out of the support structure 102, and after the filled container has been removed from the external support structure. Various side-support structures have been secured to the sides inside the containers, e.g., between both opposite, or both diagonally-adjacent, sides of the containers (referred to as "fixed-in-place internal structures"). The length of the "fixed-in-place internal structures") is an attempt to define a maximum value of a lateral space between the opposite sides, and is intended to avoid the lateral bulging of the opposite sides. However, when the exemplary dumping of the multiple front end loader bucket loads occurs into this soft-sided container having the "fixed-in-place internal structures"), the dumped bulk material often hits the "fixed-in-place internal structures", and under the force of gravity acts on those "fixed-in-place internal structures". The hitting and acting causes those "fixed-in-place internal structures" to curve downwardly and assume a curved shape extending to a lower location within the container. Because those internal structures are either rigid or non-stretchable, and as so secured to both the opposite, or adjacent, sides, the new curved shape of those structures is at the lower location and reduces the lateral (e.g., horizontal) length of those internal structures. Thus, the opposite soft-sided sides of the containers are moved toward each other, assume an inward (or reverse) bulge, and lessen the space between the opposite sides. The result is a bulge of the soft-sided walls above and below those structures, which is as disadvantageous as the outward bulge described above.

Whether such internal structures are secured to both of the opposite sides of the containers, or are secured to both of two adjacent sides of the soft-sided containers, the lateral bulging of both the inward or outward type may occur. As a result, bulging results when these containers are being filled, or lifted, or when they are stacked on top of each other.

Moreover, in each case this bulging results from undesired gravitational action of the bulk material on the fixed-in-place internal structures.

What is needed, is a configuration of a soft-sided container by which difficult-to-avoid gravitational action of the bulk material does not cause the soft-sides to maintain their substantially vertical plan nor move or shift or expand laterally, neither inwardly toward each other nor outwardly away from each other, e.g., when the container is being filled with bulk material, or when the filled container is lifted off a support surface, or when the filled container is stacked on another soft-sided container.

SUMMARY

Broadly speaking, the present invention fills these needs by a soft sided bulk material containers with hold-ins to substantially reduce or eliminate side bulging when loaded and moved. It should be appreciated that the present invention can be implemented in numerous ways, including as a process, an apparatus, a system, computer readable media, or a device. Several inventive embodiments of the present invention are described below.

One embodiment provides a method for transferring bulk material for transport, the method includes placing a first quantity of bulk material in a soft-sided bulk material container, extending a first hold-in across the container from a first side of the container to a second location, the second location being substantially toward a second side of the container, wherein the first hold-in is secured to the first side of the container, securing the first hold-in to the second location and placing a second quantity of bulk material in the container, the second quantity covering the first hold-in and securing the first hold-in to the second location with a weight of the second quantity of bulk material.

The method can also include extending a second hold-in across the container from a first side of the container to a third location, the third location being substantially toward a second side of the container, wherein the second hold-in is secured to the first side of the container, securing the second hold-in to the third location and placing a third quantity of bulk material in the container, the third quantity covering the second hold-in and securing the second hold-in to the third location with a weight of the third quantity of bulk material.

The first hold-in can include a first plurality of hold-ins and wherein extending the first hold-in across the container from the first side of the container to the second location can include alternating the first plurality of hold-ins of alternating sides of the container.

The opposing ones of the alternating first plurality of hold-ins can overlap lengthwise, widthwise or not overlap at all or a combination thereof. The opposing ones of the alternating first plurality of hold-ins can be secured to each other by a securing mechanism.

Another embodiment provides a soft-sided container a bottom, a plurality of sides coupled to the bottom, at least one hold-in secured to a first one of the plurality of sides, wherein the at least one hold-in is secured to the selected side between about 20 and 70 percent of a height of the selected side, wherein the at least one hold-in is substantially parallel to the bottom and a plurality of covering flaps.

Yet another embodiment provides a method of making a soft-sided container including forming a bottom of the container, coupling a plurality of sides to the bottom, securing at least one hold-in to a first one of the plurality of sides, wherein the at least one hold-in is secured to the selected side between about 20 and 70 percent of a height of the selected side, wherein the at least one hold-in is substantially parallel to the bottom and coupling a plurality of covering flaps to respective ones of the plurality of sides.

Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings.

DETAILED DESCRIPTION OF THE DRAWINGS

Several exemplary embodiments for non-bulging bulk soft-sided containers (bags) will now be described. It will be apparent to those skilled in the art that the present invention may be practiced without some or all of the specific details set forth herein.

Figure 3A:
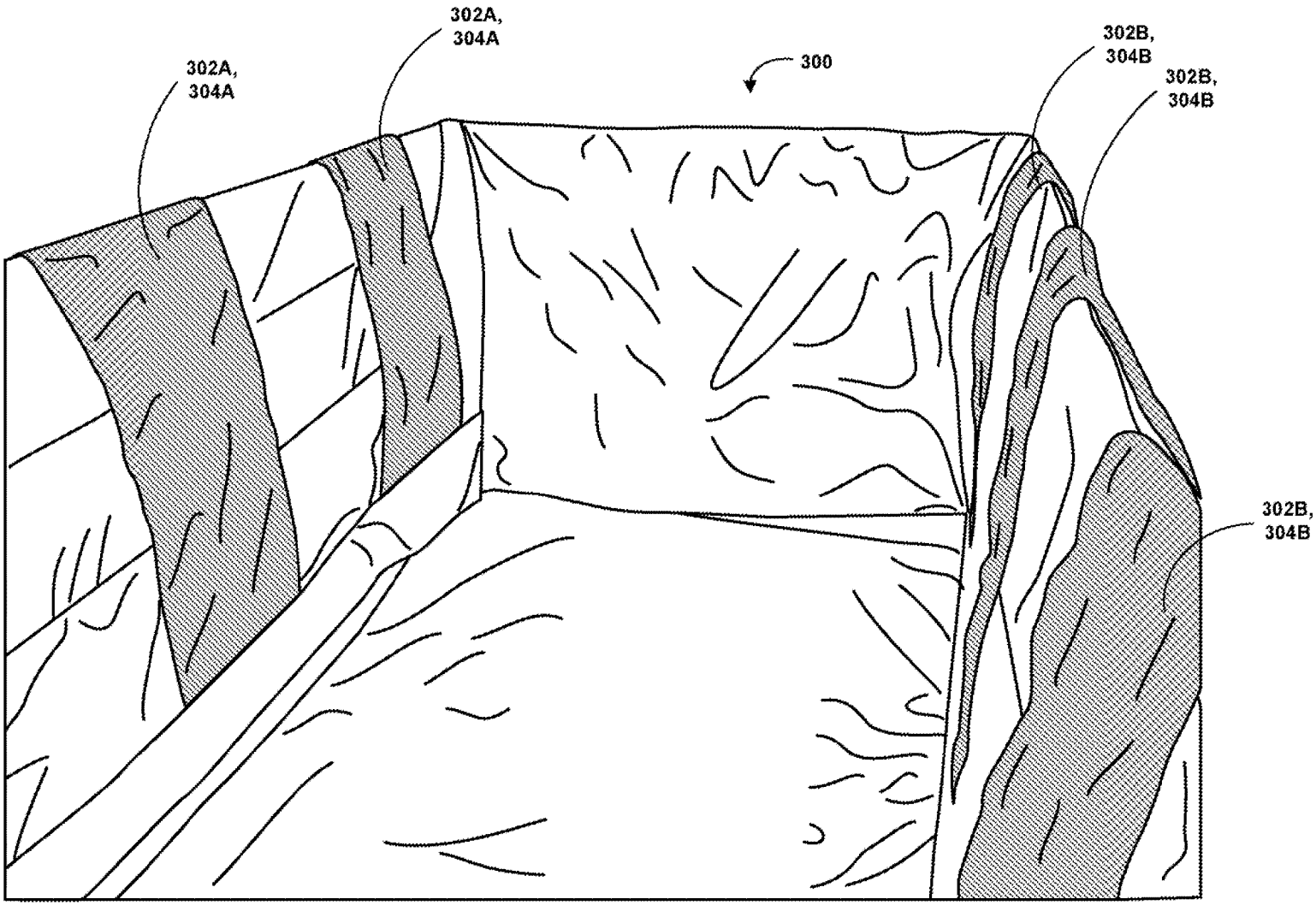
FIGS. 3A-3C show a soft-sided bulk material container with hold-ins, in accordance with embodiments of the present invention.
Figure 3B:
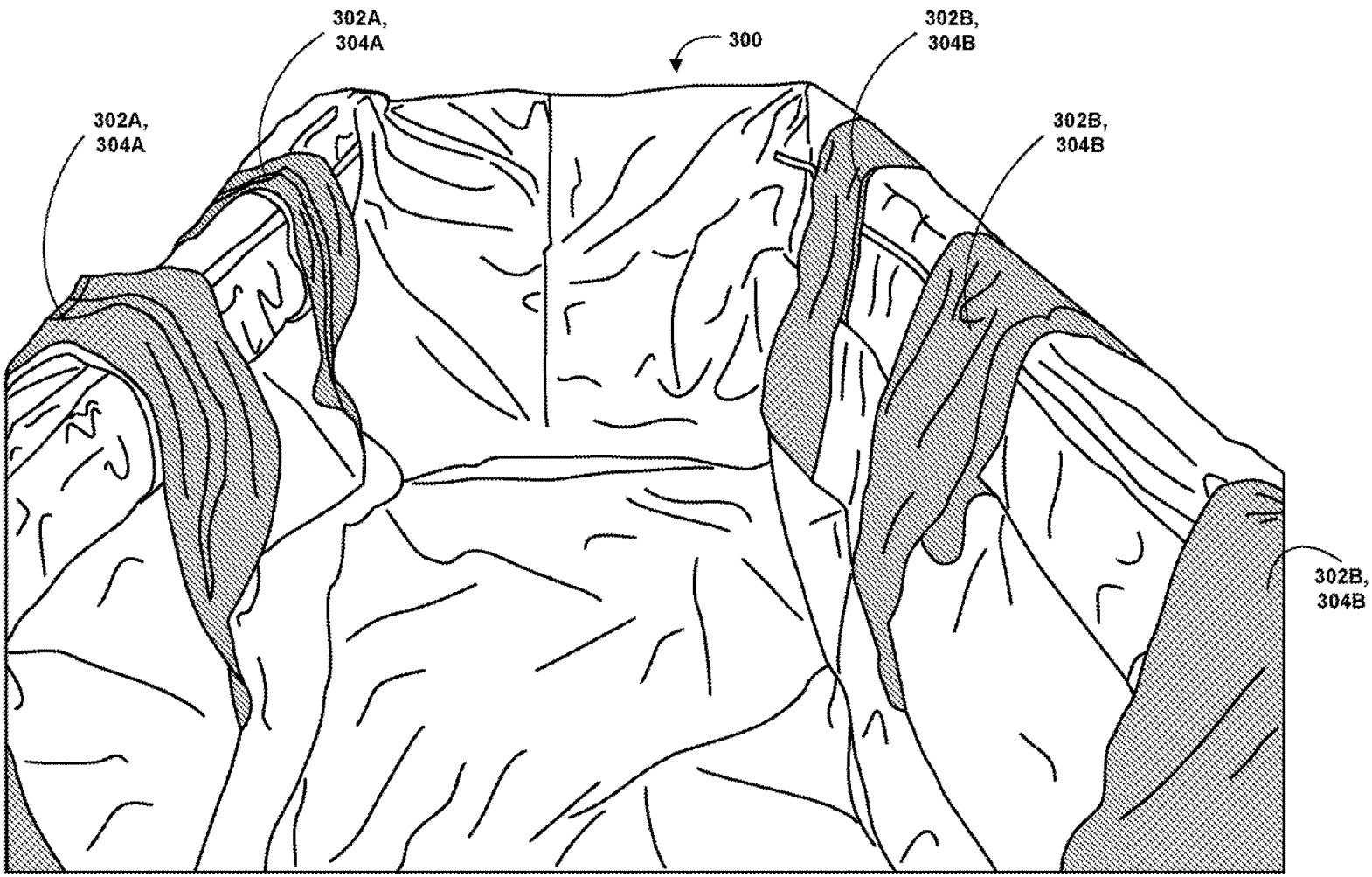
Figure 3C:
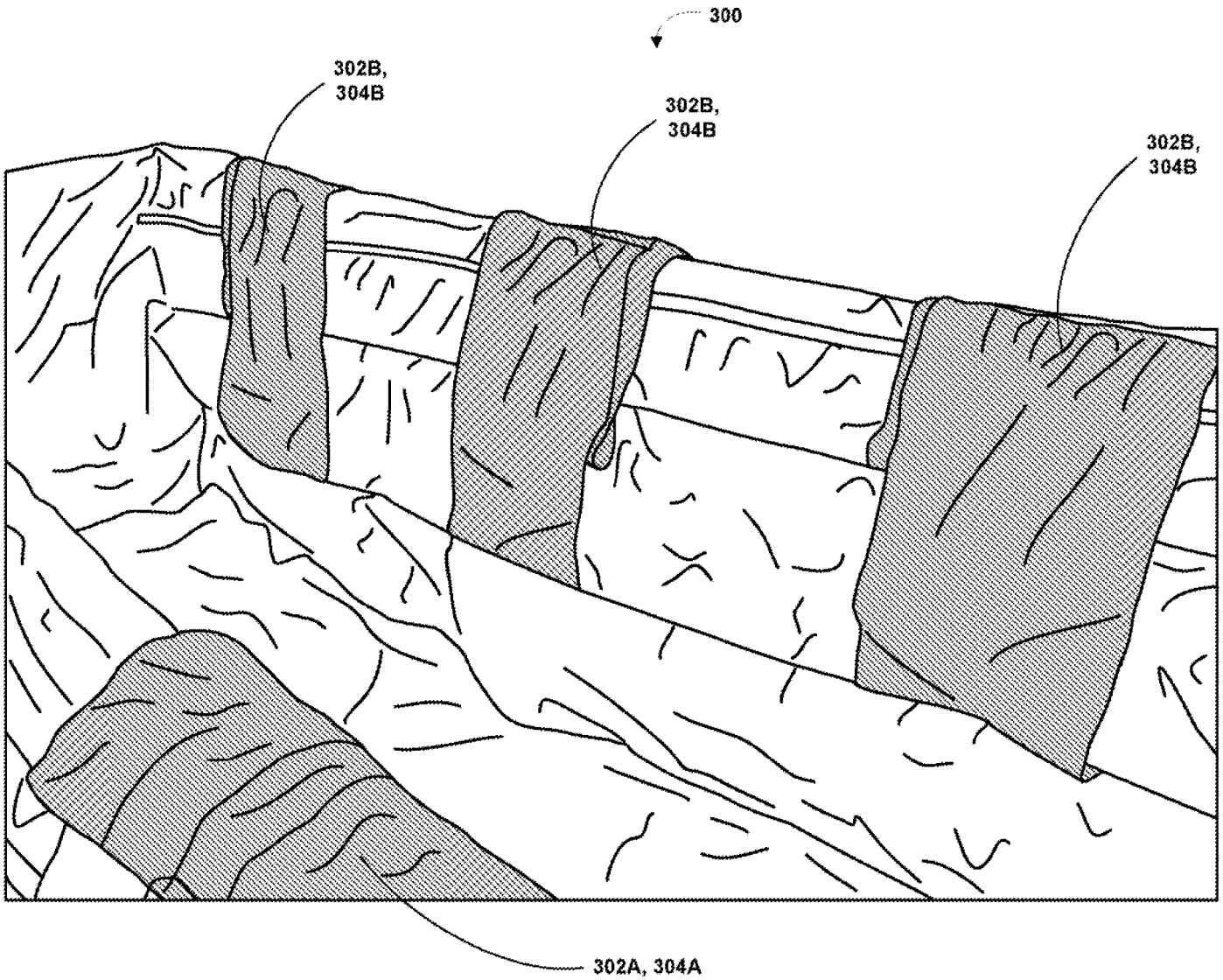

FIGS. 3A-3C show a soft-sided bulk material container 300 with hold-ins 302A, 302B, 304A, 304B, in accordance with embodiments of the present invention. The hold-ins 302A, 302B, 304A, 304B can be made from any suitable materials including the same materials as the soft-sided bulk material container or different materials such as may be water permeable while not allowing solids (e.g., sand, dirt, gravel) to pass through.

Figure 3D:
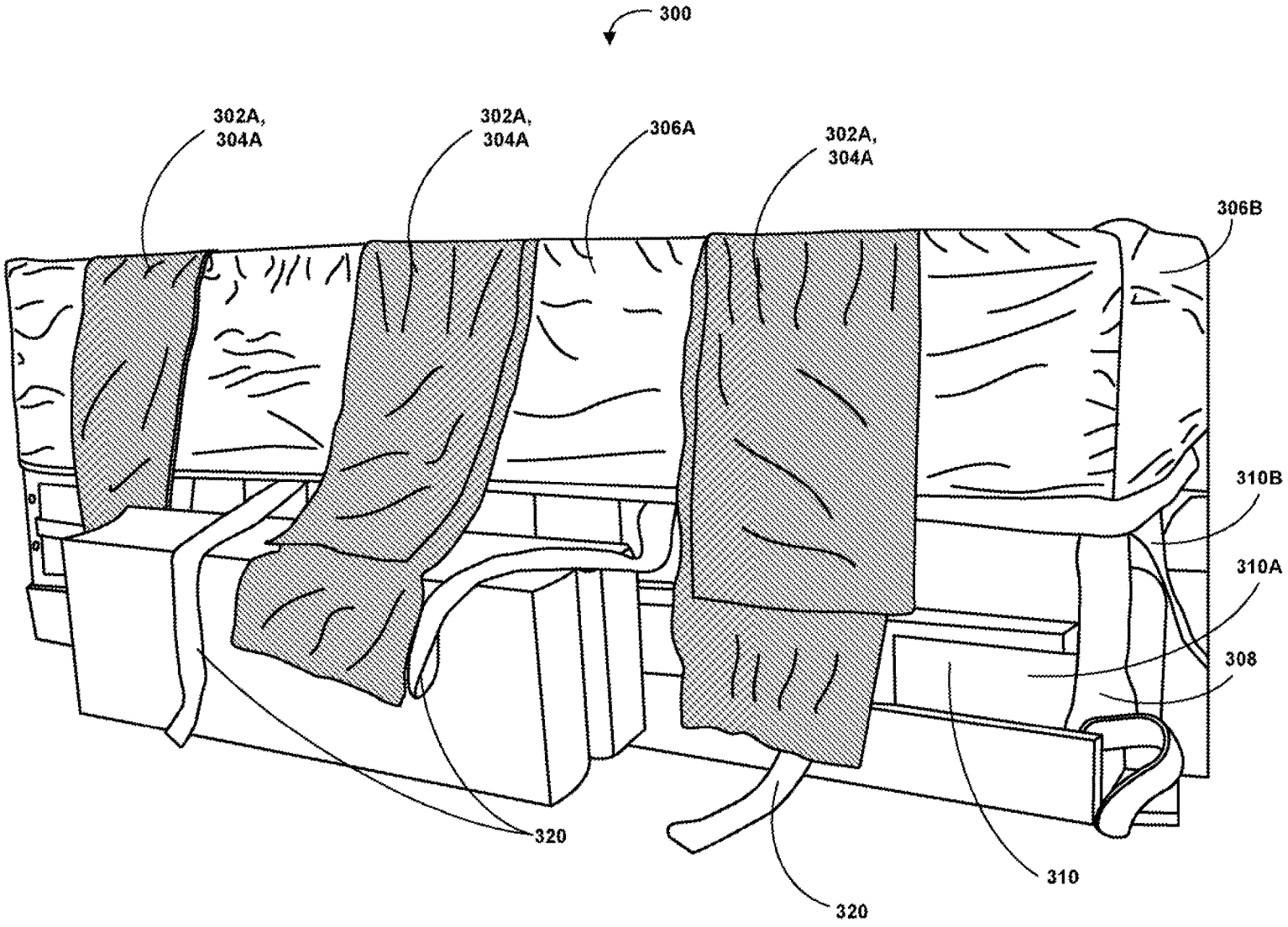
FIG. 3D shows a supported soft-sided bulk material container, in accordance with embodiments of the present invention.

FIG. 3D shows a supported soft-sided bulk material container 300, in accordance with embodiments of the present invention. The soft-sided bulk material container 300 is supported in a frame 310 for filling/loading. The frame 310 is formed from sides 310A and ends 310B that are coupled together at intersecting corners. The corners can be secured through any suitable mechanism. As shown the corners are secured with a flexible material 308. The flexible material 308 can be secured to the respective side 310A and end 310B by any suitable fastener (e.g., staples, nails, screws, latches, glue, hook and loop fasteners).

The soft-sided bulk material container 300 is supported by the frame 310 by folding the soft-sided bulk material container side 306A over a corresponding side 310A of frame 310. Similarly, the respective soft-sided bulk material container ends 306B over a corresponding side 310B of frame 310. The soft-sided bulk material container 300 also includes multiple lift straps 320 as will be described in more detail below.

FIGS. 4A-4H show the soft-sided bulk material container 300 being filled, in accordance with embodiments of the present invention. FIG. 5 is a flowchart diagram that illustrates the method operations 500 performed in filling the soft-sided bulk material container 300, in accordance with embodiments of the present invention. The operations illustrated herein are by way of example, as it should be understood that some operations may have sub-operations and in other instances, certain operations described herein may not be included in the illustrated operations. With this in mind, the method and operations 500 will now be described.

In an operation 505, the soft-sided bulk material container 300 is supported in the frame 310 as illustrated in FIGS. 3A-3D. A first quantity of bulk material 402A is placed in the container 300 in an operation 510. The first quantity of bulk material 402A partially fills the container 300 (e.g., between about 20% to about 50% of the capacity of the container 300).

Figure 4A:
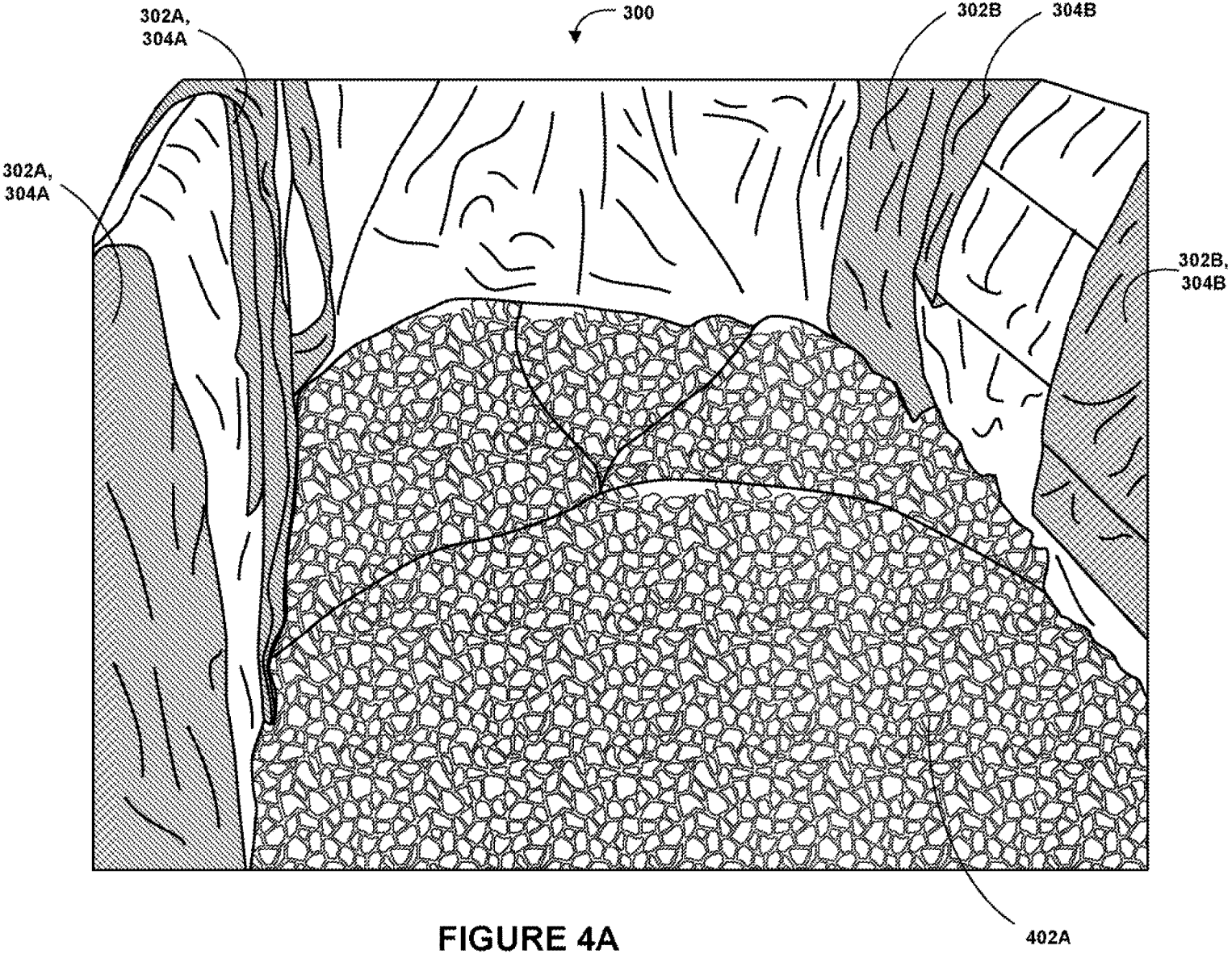
FIGS. 4A-4H show the soft-sided bulk material container being filled, in accordance with embodiments of the present invention.
Figure 4B:
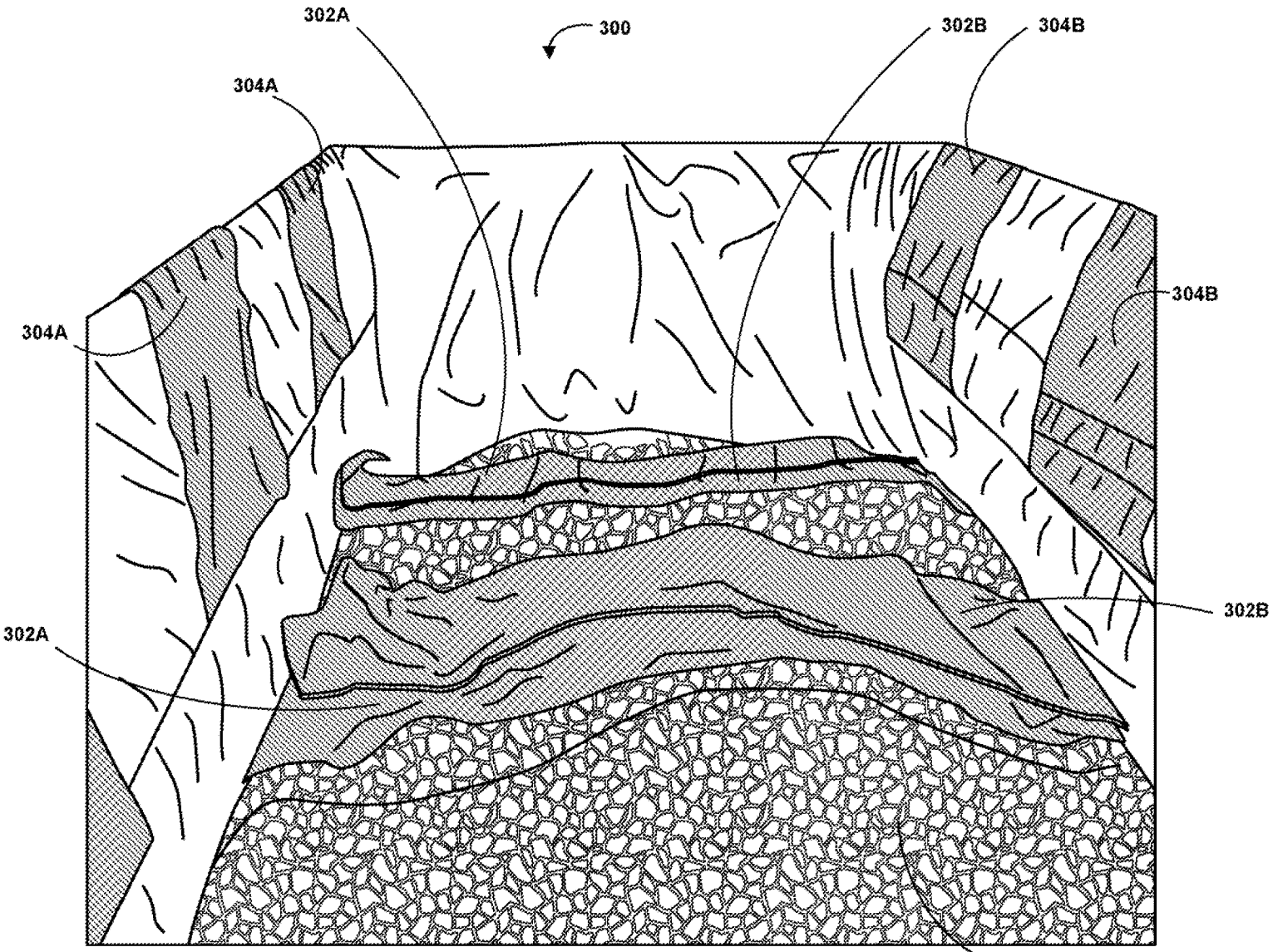
Figure 4C:
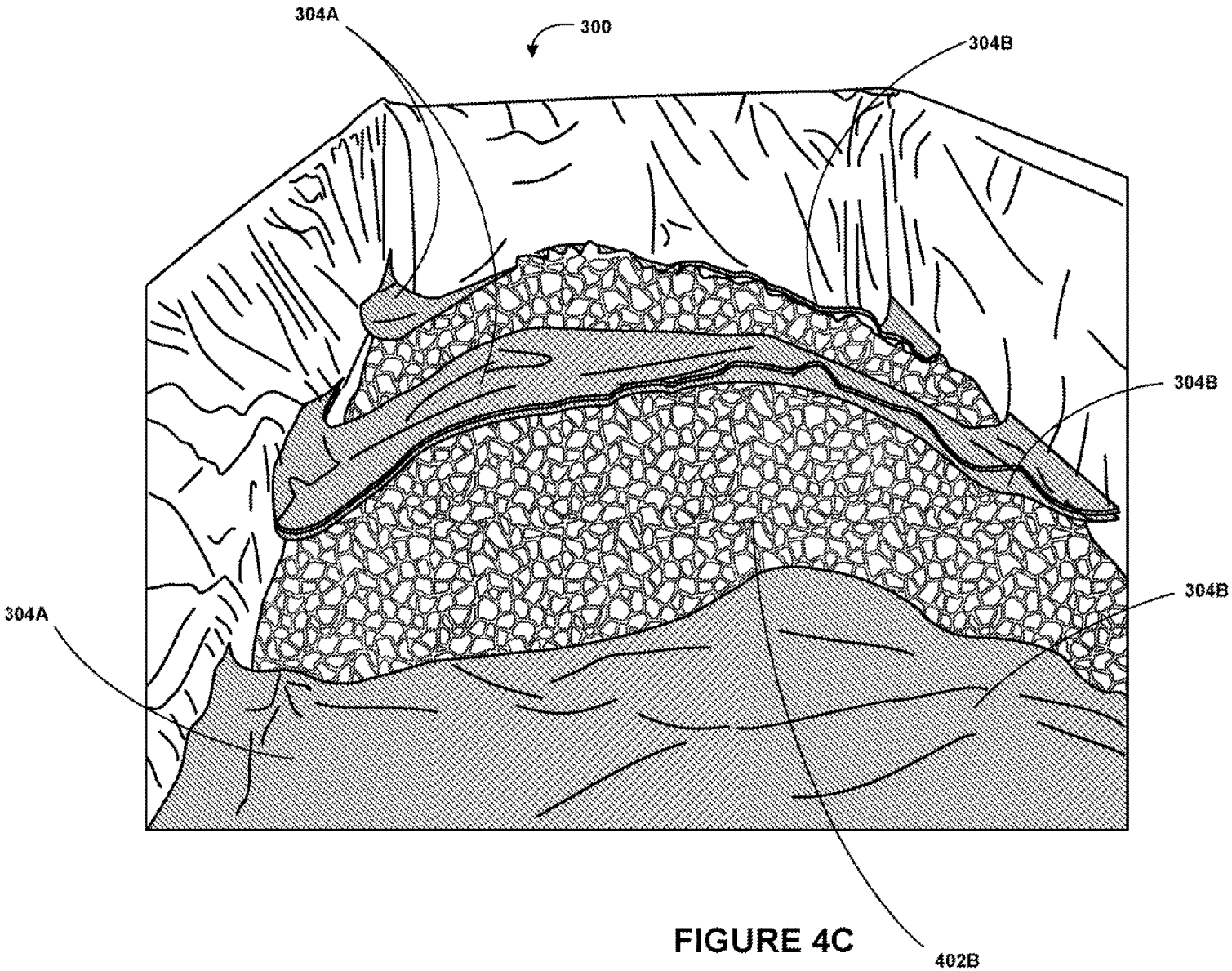
Figure 4D:
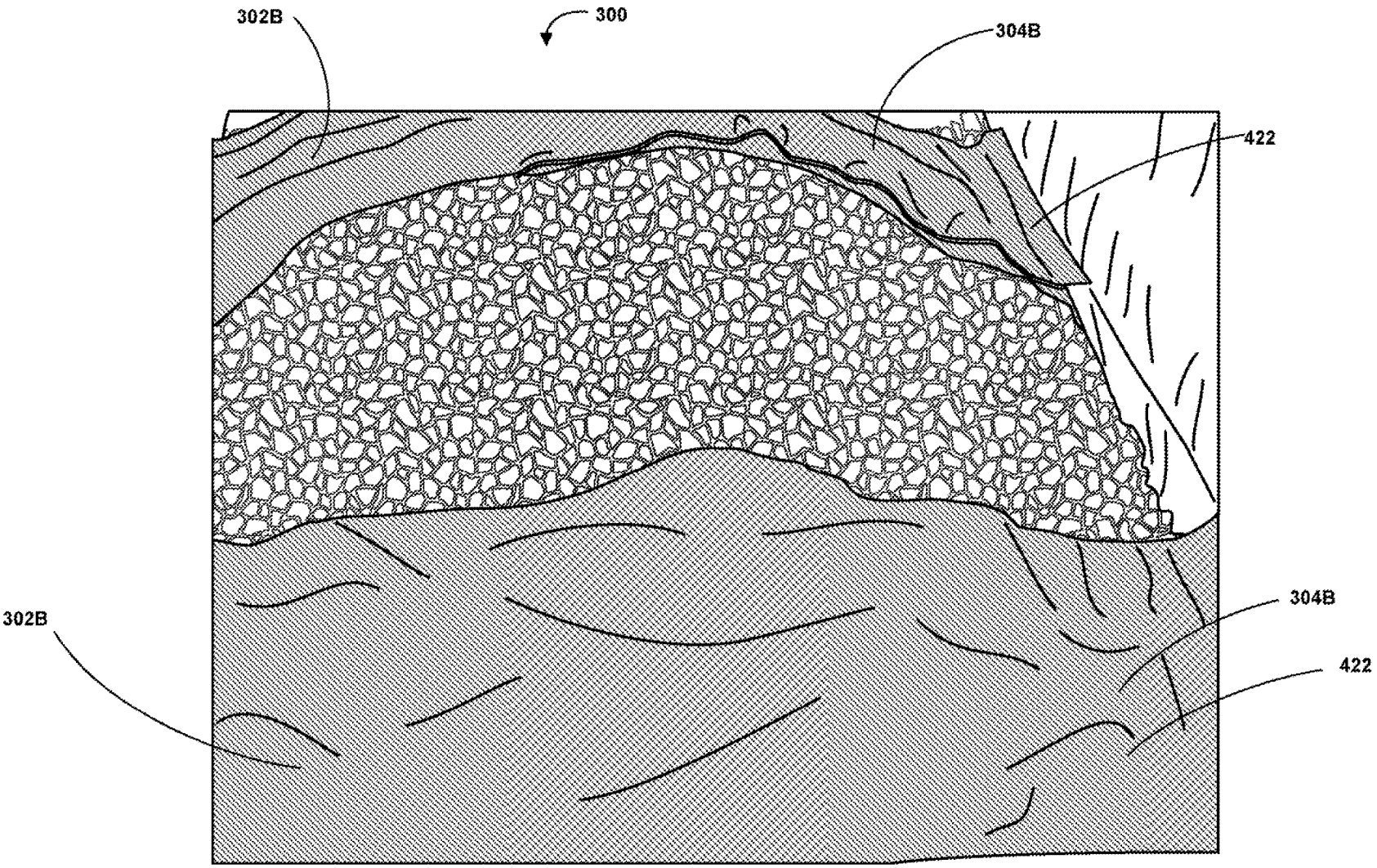
Figure 5:
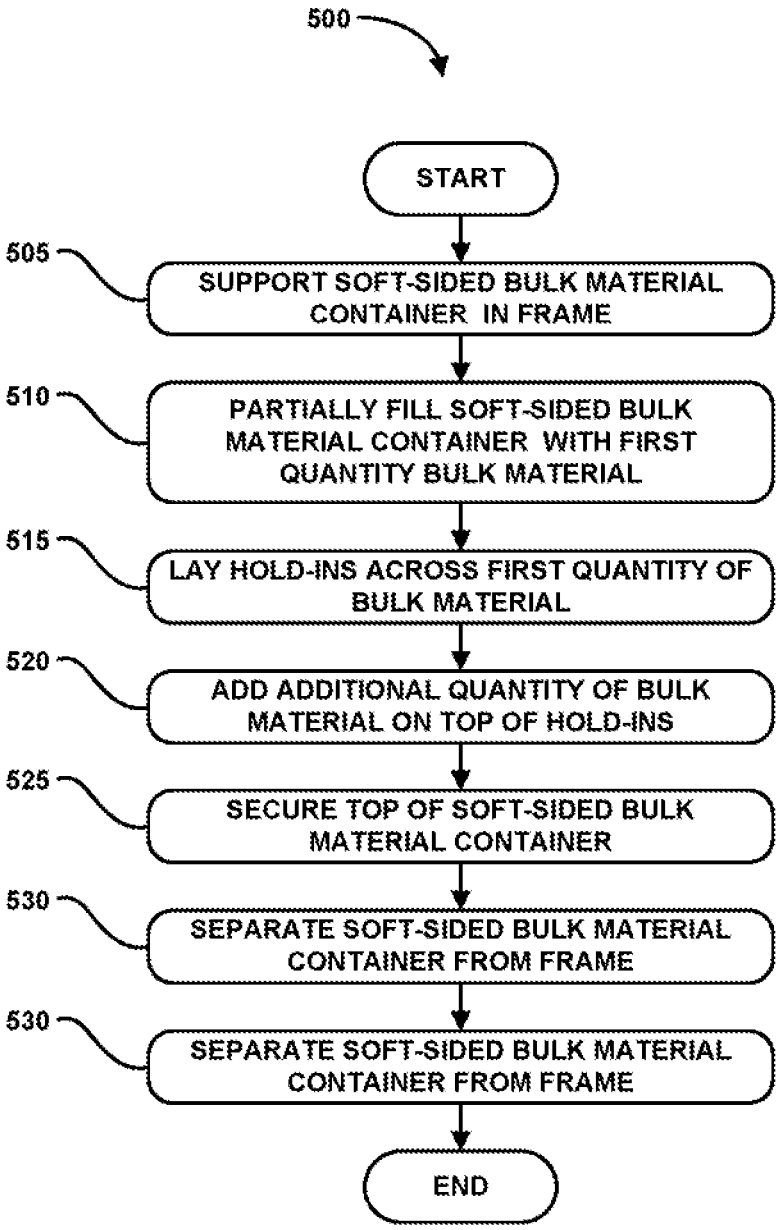
FIG. 5 is a flowchart diagram that illustrates the method operations performed in filling the soft-sided bulk material container, in accordance with embodiments of the present invention.

In an operation 515, the hold-ins 302A, 302B are laid across the first quantity of bulk material 402A as shown in FIG. 4B. The hold-ins 302A, 302B can be coupled together with laces, straps, buckles, hook and loop fasteners or other suitable fasteners 422. Hold-ins 302A, 302B can couple together with friction surfaces that hold together or interlock. The hold-ins 302A, 302B can overlap as shown. Alternatively, the hold-ins 302A, 302B can lay side by side.

In an operation 520, a second quantity 402B of bulk material is added on top of and covering the hold-ins 302A, 302B. The soft-sided bulk material container 300 can be between about 50% and about 100% filled to capacity. If only one set or layer of hold-ins 302A, 302B are used, then the about 40-60% of the bulk material is filled in the first quantity 402A and the remaining capacity is filled with the second quantity 402B of bulk material.

Alternatively and as shown in FIGS. 3A-4H, a second set or layer of hold-ins 304A, 304B are used and thus the first quantity 402A is between about 20% and about 50% of the capacity of the soft-sided bulk material container 300. The second quantity of material 402B fills the soft-sided bulk material container 300 to between about 50% to about 80% capacity, then the second set or layer of hold-ins 304A, 304B are laid over the second quantity of bulk material 402B similar to how the hold-ins 302A, 302B are laid across the first quantity of bulk material 402A as shown in FIGS. 4C and 4D.

Figure 4E:
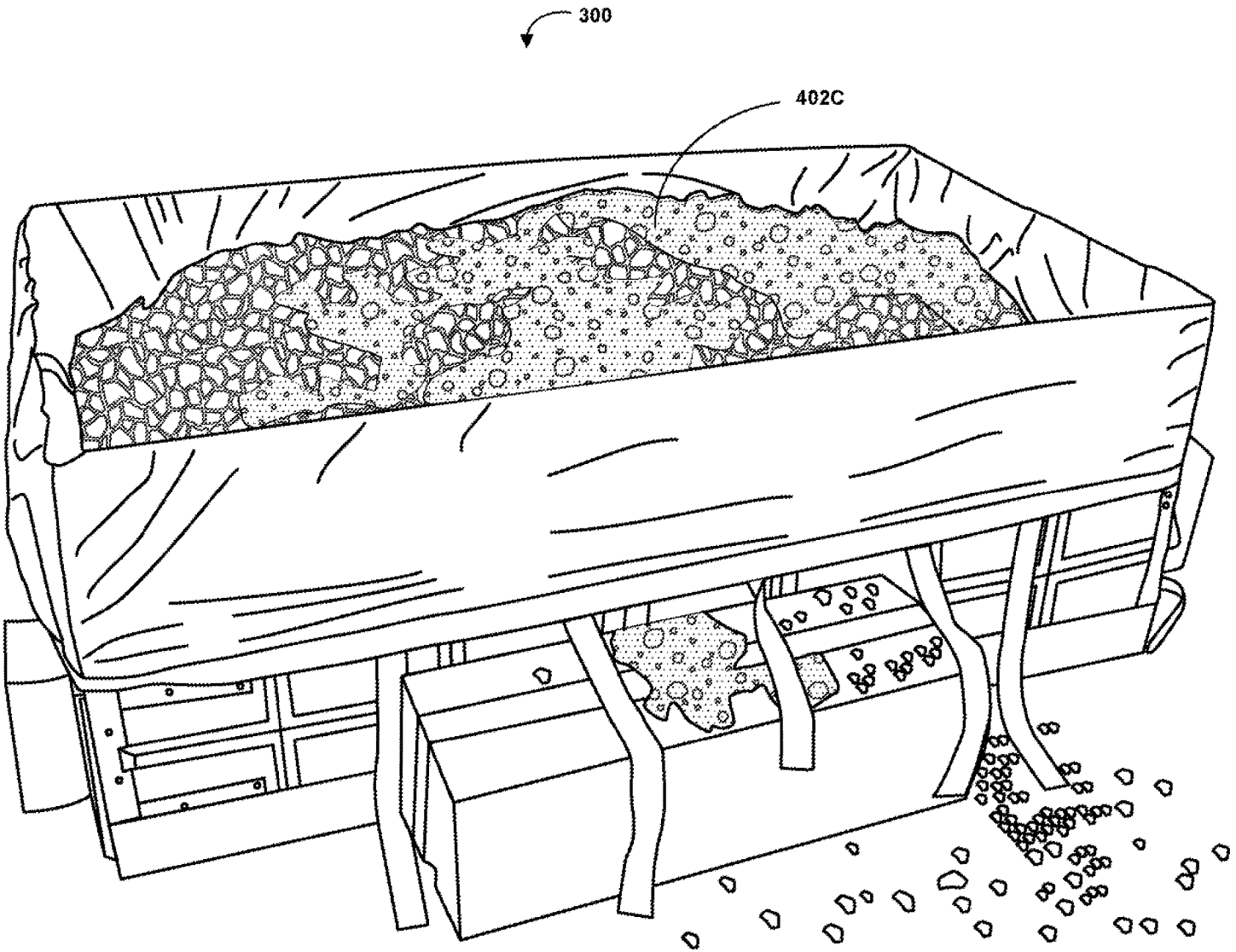
Figure 4F:
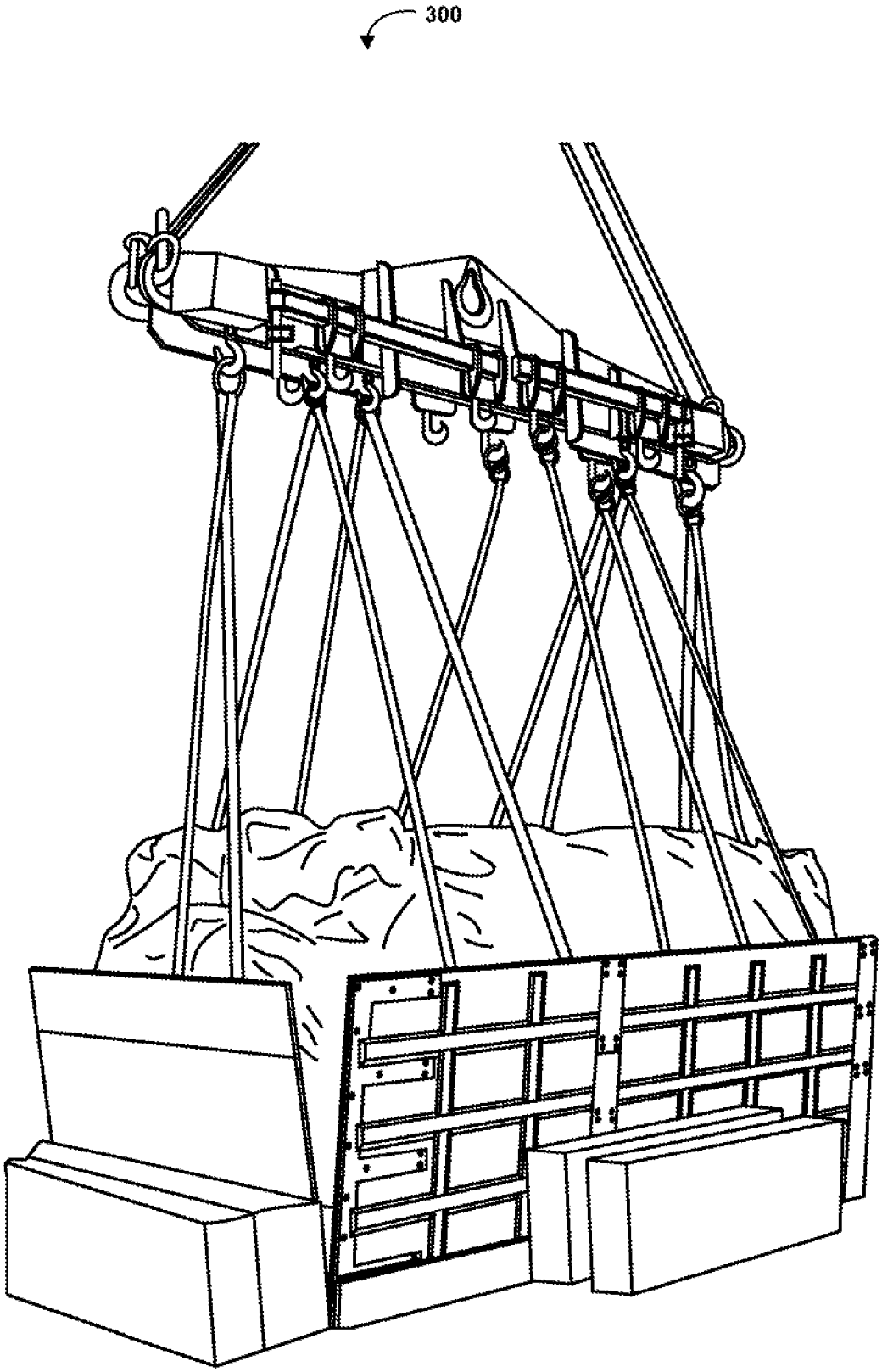

As shown in FIG. 4E, a third quantity of bulk material 402C is added on top of and covering the second set or layer of hold-ins 304A, 304B to substantially fill the soft-sided bulk material container 300. The weight of the bulk material 402B, 402C on top of the respective hold-ins 302A, 302B, 304A, 304B hold the hold-ins so that the soft-sided bulk material container 300 cannot expand horizontally when removed from the frame 310.

In an operation 525, the soft-sided bulk material container 300 is secured. Securing the soft-sided bulk material container 300 includes laying the sides 306A and ends 306B of the soft-sided bulk material container 300 over the third quantity of bulk material 402C.

In an operation 530, the soft-sided bulk material container 300 is separated from the frame 310 and moved to a different location from the frame in an operation 535 and the method operations can end. Separating the soft-sided bulk material container 300 and the frame 310 can include removing or disassembling the frame 310. Separating the soft-sided bulk material container 300 and the frame 310 can include using the lift straps 320 to lift the soft-sided bulk material container 300 from the frame 310 as shown in FIG. 4G.

Figure 1:
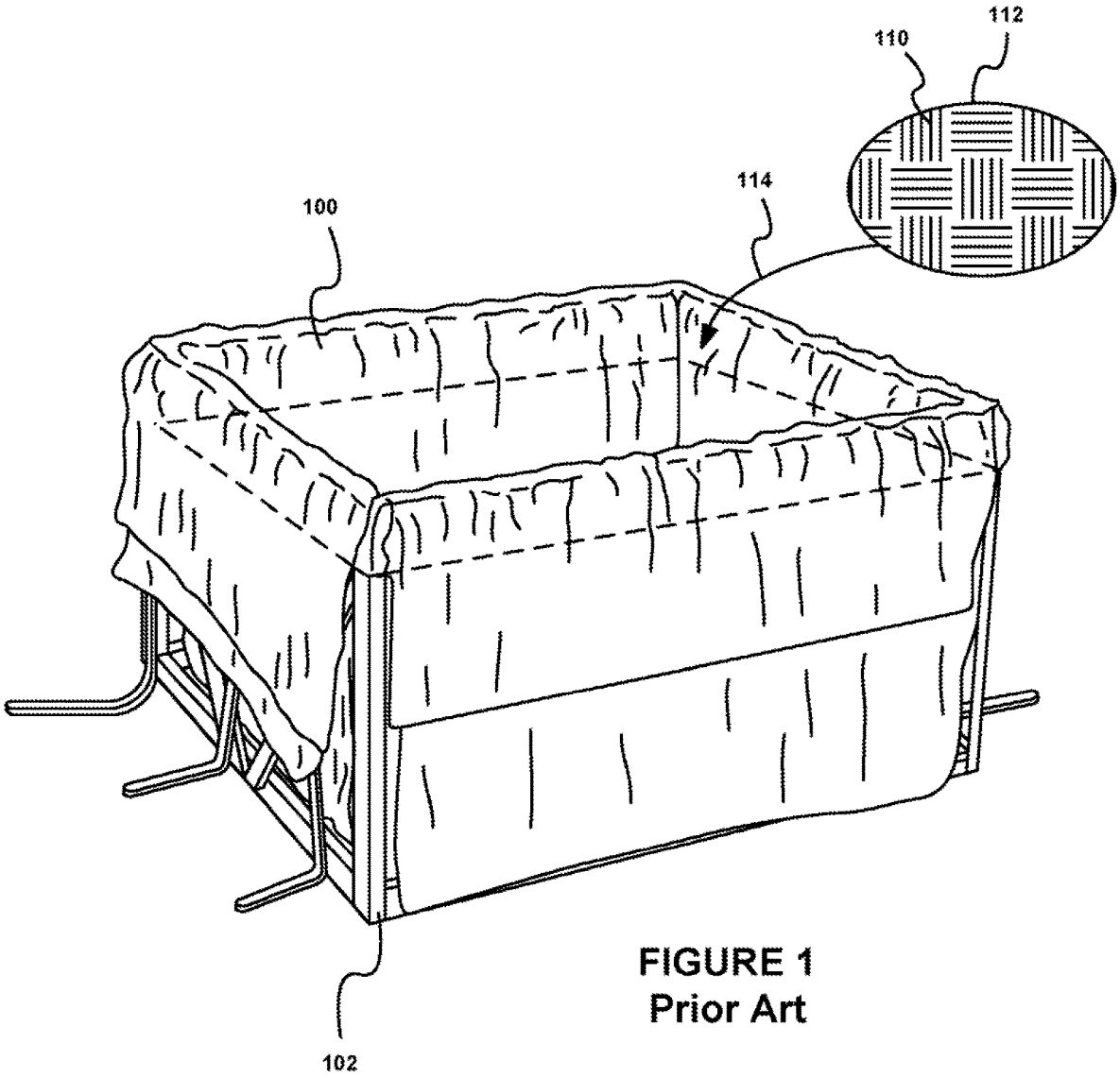
FIGURE 1 Prior Art
FIG. 1 is a simplified schematic of a typical soft-sided container supported in an external support structure.
Figure 2:
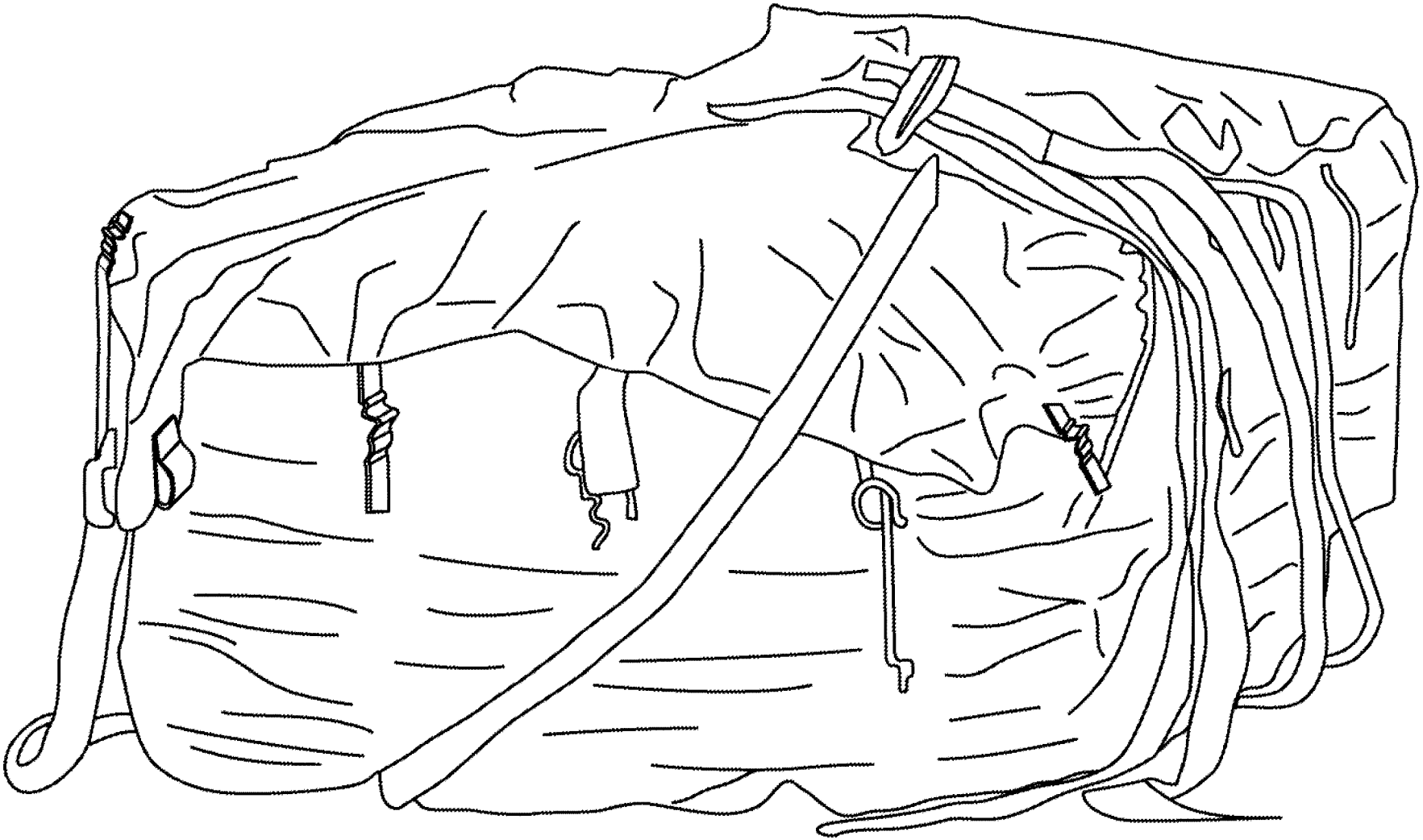
FIGURE 2 Prior Art
FIG. 2 is a typical, rectangular soft-sided bulk material container.
Figure 4G:
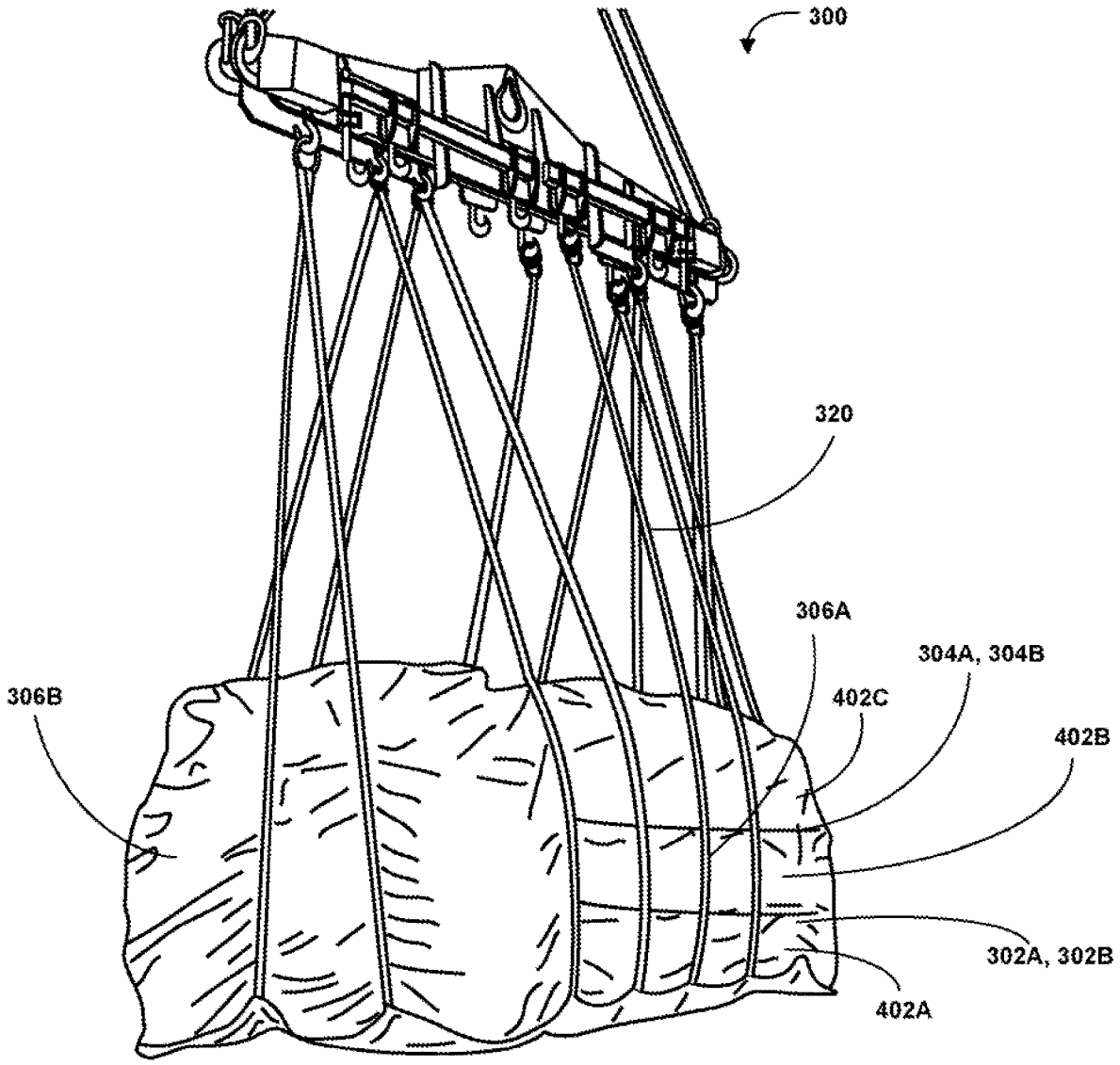
Figure 4H:
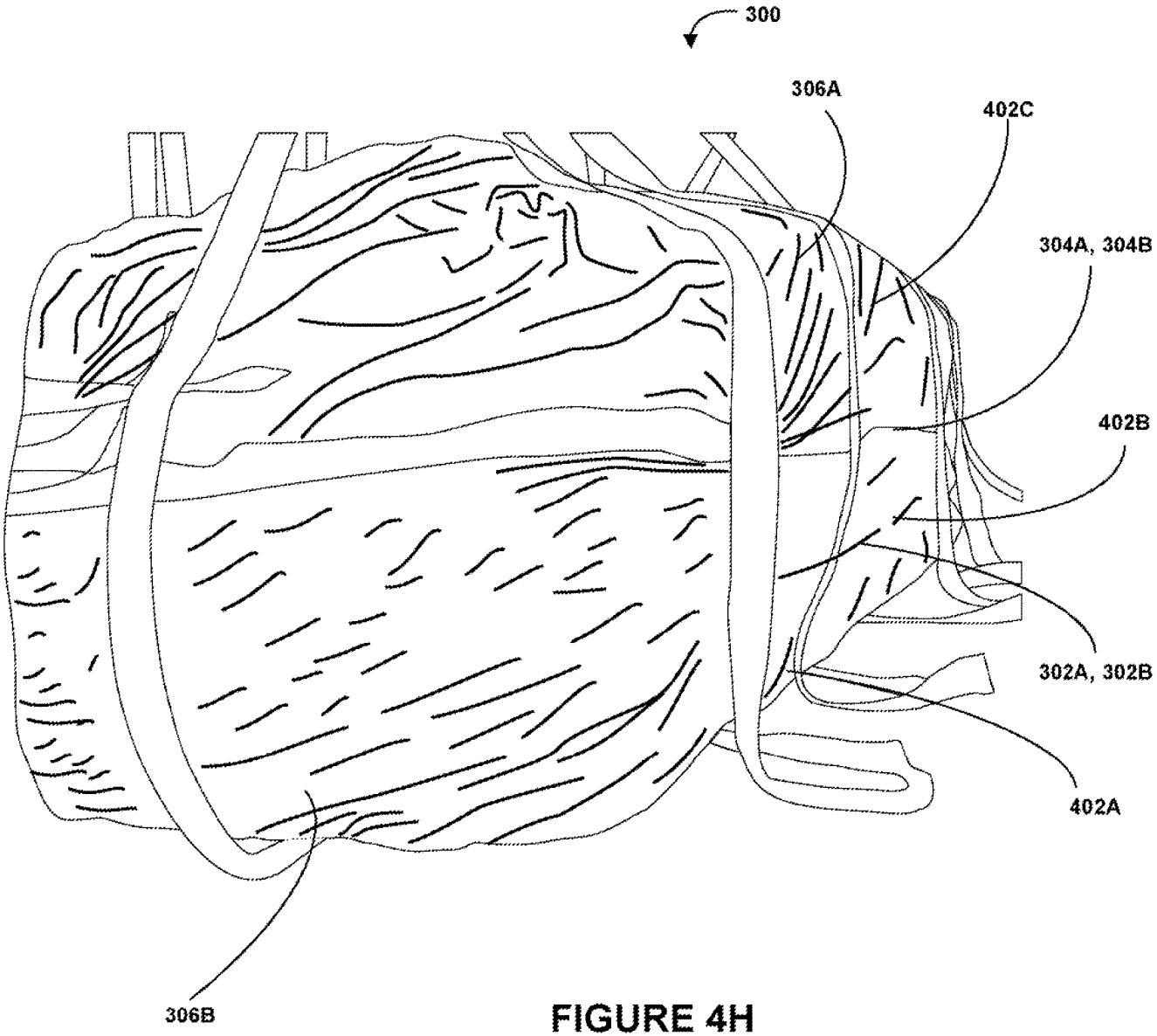

As also shown in FIG. 4G, the layers 402A-402C and hold-ins 302A, 302B, 304A, 304B are visibly separated in the side 306A of the soft-sided bulk material container 300. As also shown in FIGS. 4G and 4H, the side 306A and end 306B of the soft-sided bulk material container 300 remain substantially vertical and do not substantially curve or bulge outward like the typical, rectangular soft-sided bulk material container 100 as shown in FIG. 2 above.

Figure 6A:
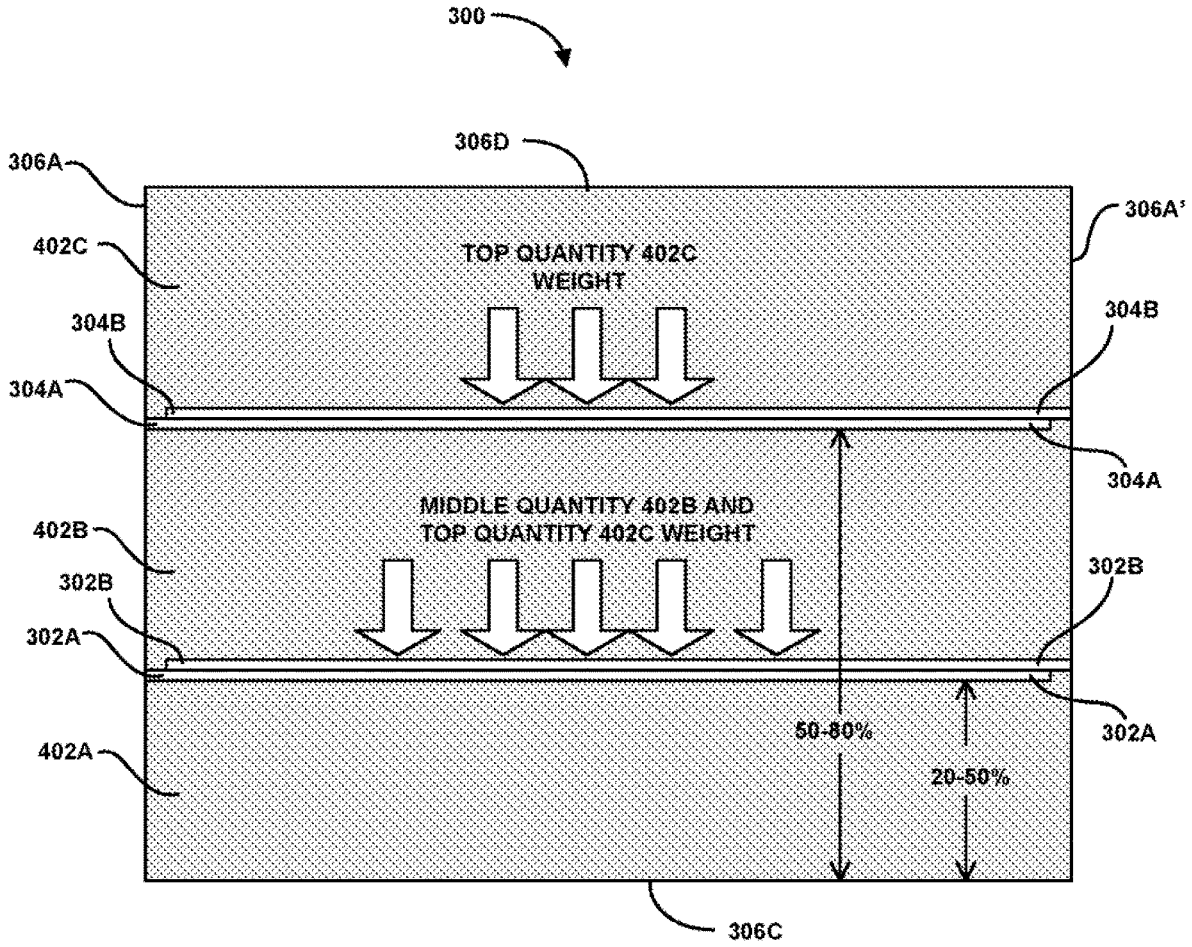
FIG. 6A is a side cross sectional schematic view of the soft-sided bulk material container, in accordance with embodiments of the present invention.
Figure 6B:
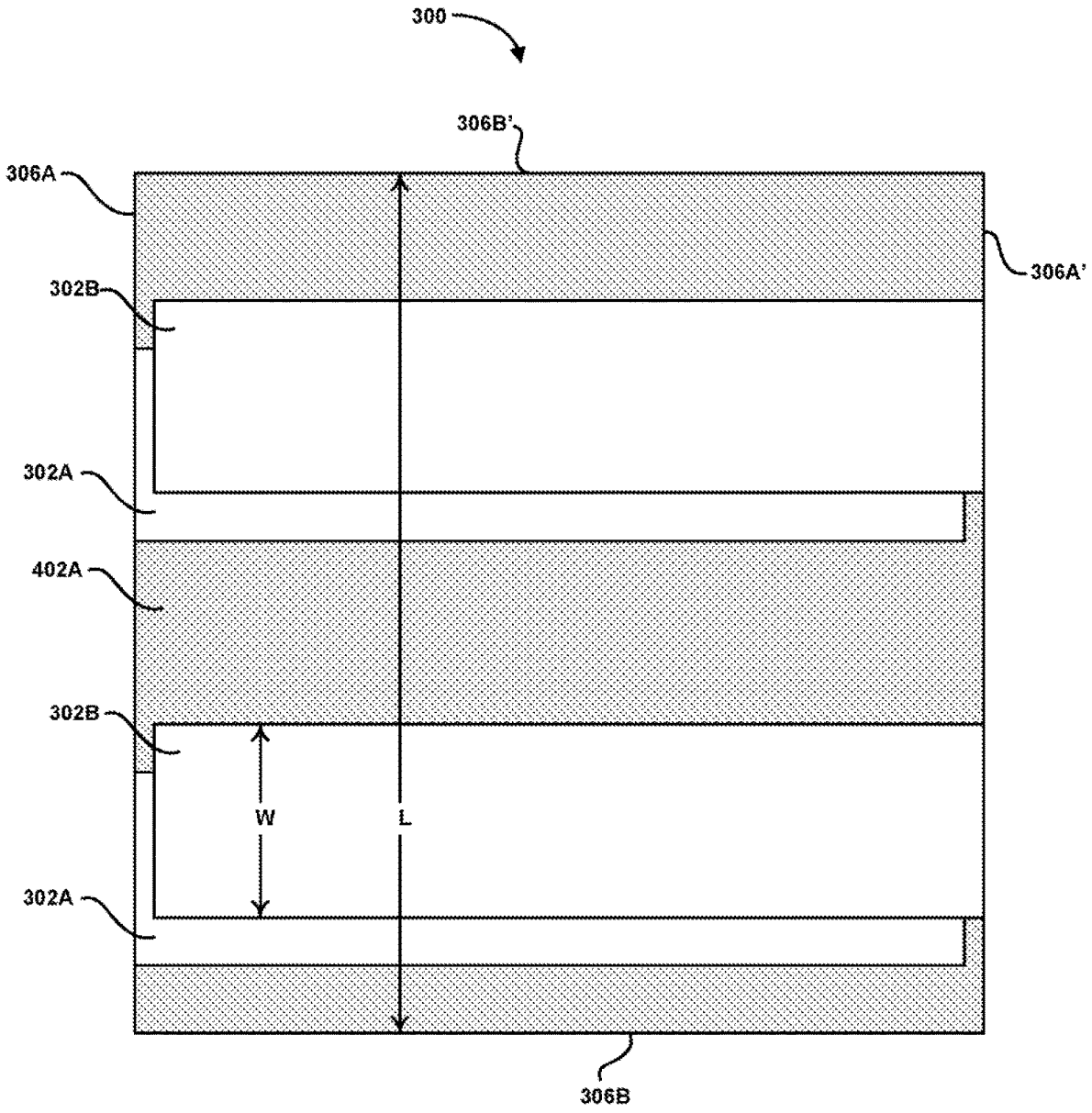
FIG. 6B is a top view of the soft-sided bulk material container, in accordance with embodiments of the present invention.

FIG. 6A is a side cross sectional schematic view of the soft-sided bulk material container 300, in accordance with embodiments of the present invention. FIG. 6B is a top view of the soft-sided bulk material container 300, in accordance with embodiments of the present invention.

The soft-sided bulk material container 300 includes a bottom 306C, opposing sides 306A, 306A' and a top 306D. Ends 306B and 306B' are not shown.

Hold-ins 302A, and 304A are attached to first side 306A of soft-sided bulk material container 300. Hold-ins 302B, 304B are attached to second side 306A' of soft-sided bulk material container 300. The hold-ins 302A, 302B, 304A, 304B can be attached to the respective sides 306A, 306A' through any suitable attachment mechanism. A relatively simple attachment mechanism is by sewing or otherwise bonding the hold-ins 302A, 302B, 304A, 304B to the respective sides 306A, 306A'.

The hold-ins 302A, 302B, 304A, 304B can partially or fully extend across from their respective sides 306A, 306A' of the soft-sided bulk material container 300 to the opposing side of the soft-sided bulk material container. The hold-ins 302A, 302B, 304A, 304B can optionally be secured to the respective opposing side 306A, 306A' of the soft-sided bulk material container 300. Optionally, the hold-ins 302A, 302B, 304A, 304B can optionally be secured to a respective opposite hold-in.

The weight of the third quantity of bulk material 402C presses down on hold-ins 304A, 304B and thus allows the hold ins to maintain the position and not allow the sides 306A, 306A' to shift or bulge outward. Similarly, the weight of the second and third quantities of bulk material 402B, 402C press down on hold-ins 302A, 302B and thus allows the hold ins to maintain the position and not allow the sides 306A, 306A' to shift or bulge outward.

While two layers of hold-ins are shown, it should be understood that only one layer of hold-ins or more than two layers (e.g., three or up to ten or more layers of hold-ins) could be used. It should also be understood that hold-ins can be attached to the ends 306B, 306B' of the soft-sided bulk material container 300 in additional to or instead of one or more of the layers of hold ins.

Hold-ins 302A, 302B can partially or fully extend across from their respective sides 306A, 306A' of the soft-sided bulk material container 300 to the opposing side of the soft-sided bulk material container. The hold-ins 302B can partially or fully cover the opposing hold-ins 302A. Hold-ins 302A, 302B can be distributed approximately evenly along the length L of the soft-sided bulk material container 300. The width W and number of the hold-ins can vary as needed according to the type of bulk material 402. By way of example, if the bulk material 402 is a relatively larger aggregate (e.g., average size of 4 inches, 10 cm or larger) may need more or less numbers of and layers of hold-ins than if the bulk material is a relatively smaller aggregate (e.g., sand or dirt having an average size of about 1 mm or smaller).

Figure 6C:
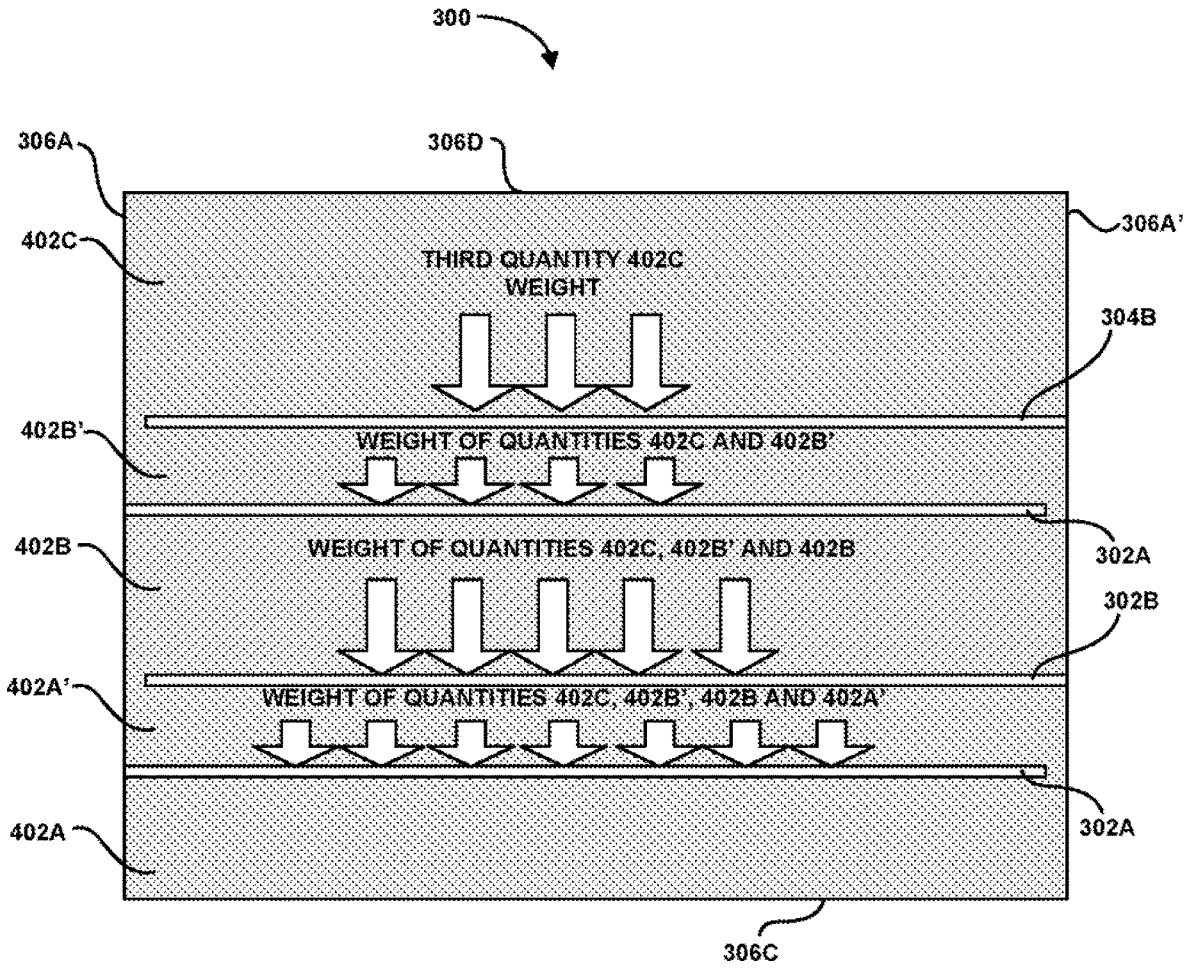
FIG. 6C is an end cross-section view of a filled soft-sided bulk material container, in accordance with an embodiment of the present invention.

FIG. 6C is an end cross-section view of a filled soft-sided bulk material container 300, in accordance with an embodiment of the present invention. The hold-ins 302A, 302B, 304A and 304B can be separated by respective quantity of bulk material. By way of example, hold-ins 302A and 302B can be separated by a first intermediary bulk material quantity 402A'. Similarly hold-ins 304A and 304B can be separated by a second intermediary bulk material quantity 402B'. The respective weights of the quantities 402C, 402B', 402B, 402A' press down on the respective hold ins 302A, 302B, 304A and 304B as shown.

Figure 6D:
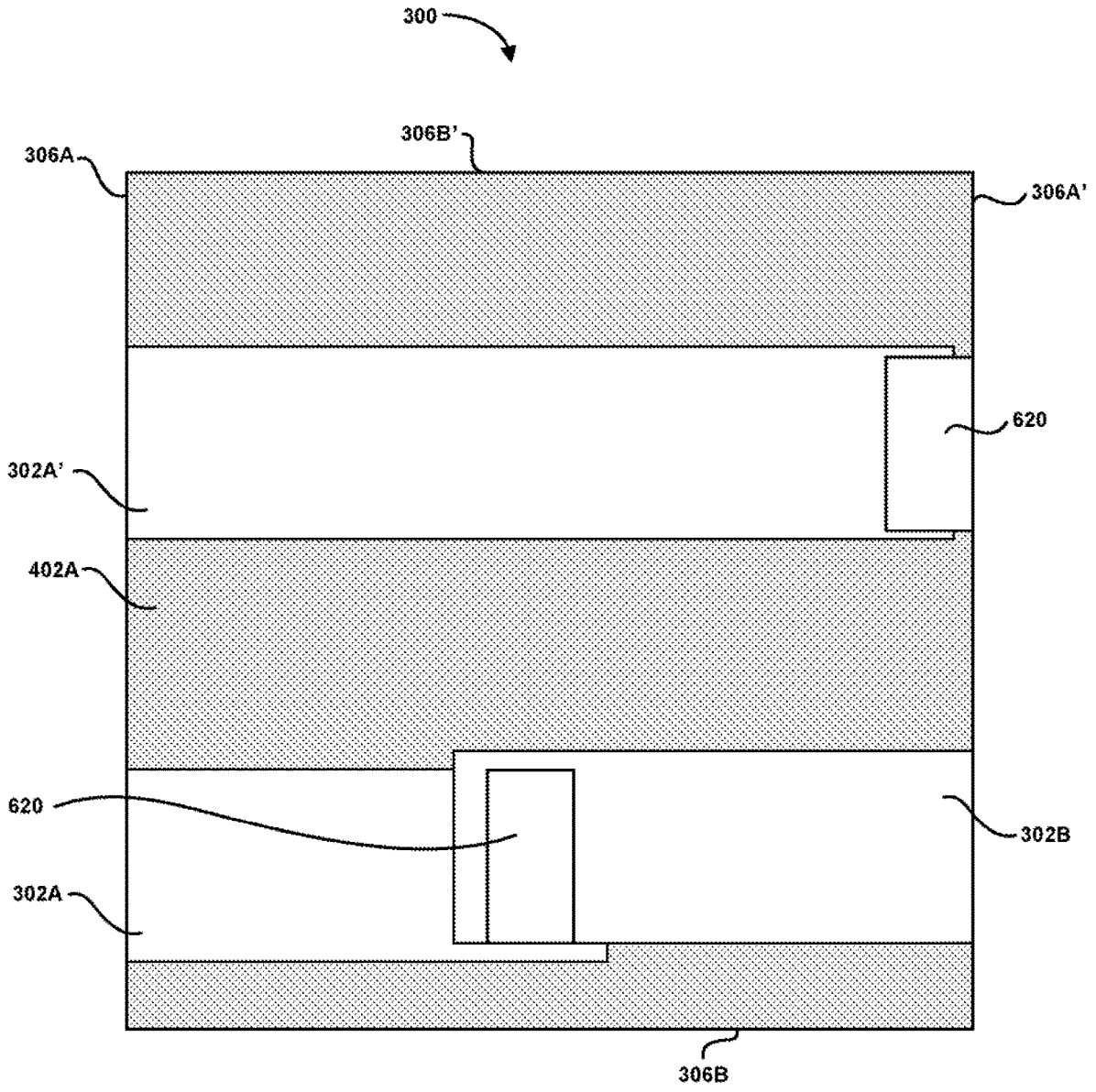
FIGS. 6D and 6E are top views of the soft-sided bulk material container, in accordance with embodiments of the present invention.
Figure 6E:
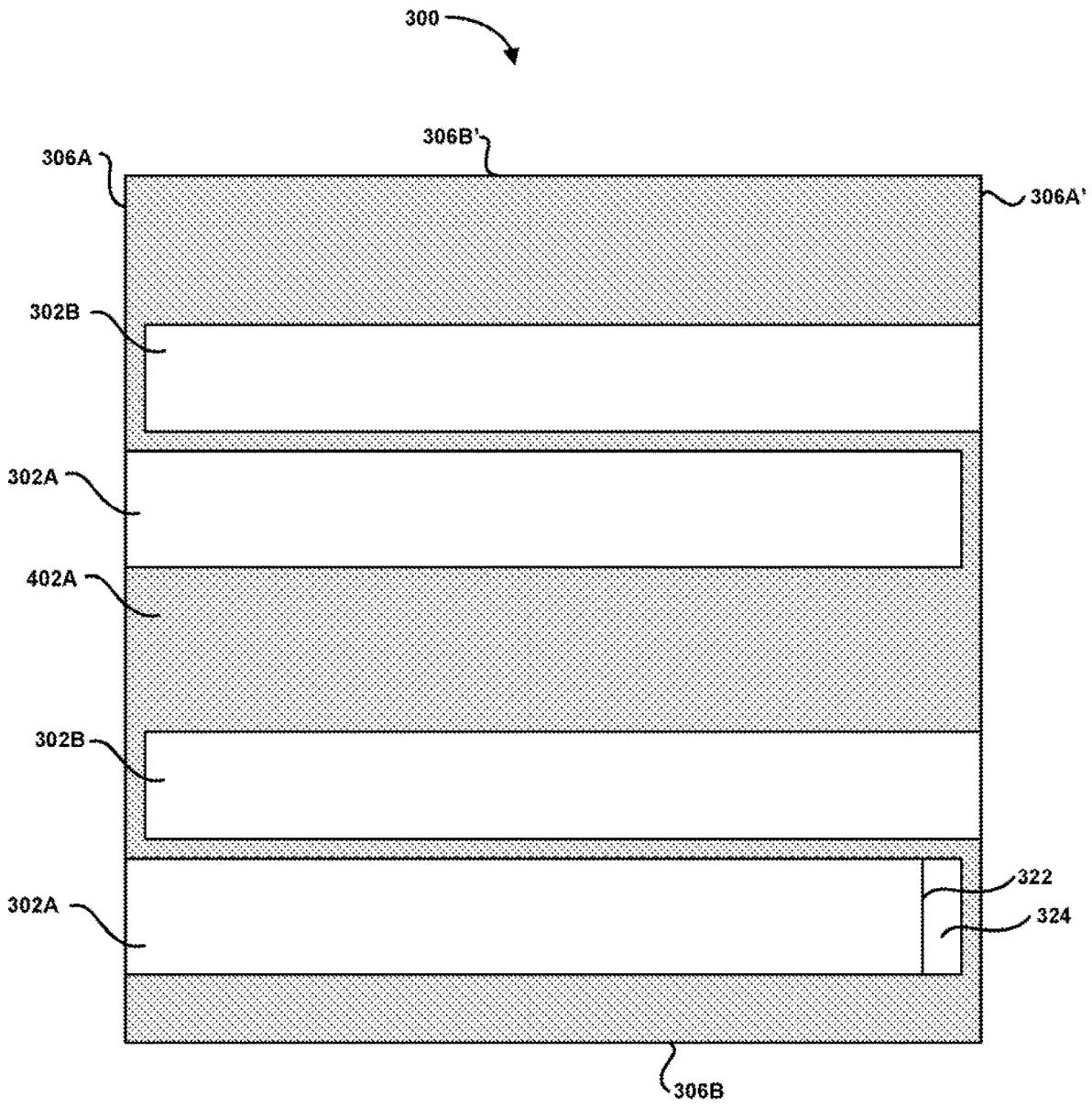

FIGS. 6D and 6E are top views of the soft-sided bulk material container 300, in accordance with embodiments of the present invention. Hold-ins 302A and 302B are coupled together by coupling mechanism 620. Coupling mechanism can be an adhesive, a latch a buckle, a hook and loop fastener, laces, or any other suitable coupling mechanism. Hold-in 302A' can be secured to the opposing side 310B with a coupling mechanism 620. If the hold-in is secured to both sides 306A, 306A' of the soft-sided bulk material container 300, then an opposing hold-in may not be required. For example if 302A' is secured to both sides 306A, 306A', then an overlying hold-in 302B may not be required.

Hold-ins 302A are attached to first side 306A of soft-sided bulk material container 300. Hold-ins 302B are attached to second side 306A' of soft-sided bulk material container 300. Hold-ins 302A, 302B can partially or fully extend across from their respective sides of the soft-sided bulk material container to the opposing side of the soft-sided bulk material container. The Hold-ins 302B and hold-ins 302A can alternate along the length of the soft-sided bulk material container 300.

An optional block 324 can be attached to an unsecured end 322 of one of the hold-ins 302A. The optional block 324 can be anything suitable for griping the bulk material such as a pipe or rock or block that can be used to add thickness to the hold-in 302A so that the end 322 cannot be easily pulled through the bulk material filled on top of the hold-in 302A. It should be understood that the hold-ins could also be arranged along the length of the soft-sided bulk material container 300 from end 306B to end 306B' similar to how the hold-ins are arranged from side 306A to 306A'.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed:

1. A method of packaging bulk material, the method comprising:

providing a soft-sided container comprising:

a plurality of sides attached to a bottom, wherein each side of the plurality of sides has a corresponding height extending from the bottom towards a top opening defined in the container;

at least one closable top to open and close the top opening; and at least one hold-in having a first end and a second end, wherein the first end of the hold-in is horizontally attached to a first side of the plurality of sides at a location ranging from between 20 and 70 percent of the height of the first side, and wherein the second end of the hold-in is not initially secured;

placing a first quantity of bulk material into the container through the top opening, wherein the first quantity of bulk material only partially fills the container;

extending the hold-in from the first side of the plurality of sides towards a second side of the plurality of sides, wherein the second side is opposite of the first side; and placing a second quantity of bulk material into the container through the top opening, wherein the second end of the hold-in includes a means for griping at least one of the following: the first quantity of bulk materials or the second quantity of bulk materials, and wherein the means for griping includes at least one item selected from a group comprising: a block, a pipe, and a rock.

2. A method of packaging bulk material, the method comprising:

providing a soft-sided container comprising:

a plurality of sides attached to a bottom, wherein each side of the plurality of sides has a corresponding height extending from the bottom towards a top opening defined in the container;

at least one closable top to open and close the top opening; and at least one hold-in having a first end and a second end, wherein the first end of the hold-in is horizontally attached to a first side of the plurality of sides at a location ranging from between 20 and 70 percent of the height of the first side, and wherein the second end of the hold-in is not initially secured;

placing a first quantity of bulk material into the container through the top opening, wherein the first quantity of bulk material only partially fills the container;

extending the hold-in from the first side of the plurality of sides towards a second side of the plurality of sides, wherein the second side is opposite of the first side; and placing a second quantity of bulk material into the container through the top opening, wherein the second end of the hold-in includes a means for griping at least one of the following: the first quantity of bulk materials or the second quantity of bulk materials, and wherein the means for griping at least partially secures the second end of the hold-in and at least partially prevents the second end of the hold-in from being pulled through the first and second quantity of bulk materials.

3. The method of claim 2, wherein the container comprises a plurality of hold-ins, wherein each of the plurality of hold-ins has:

a first end and a second end, the first end horizontally attached to a side of the plurality of sides at a location ranging from between 20 and 70 percent of the height of the side to which it is horizontally attached, and the second end not initially secured.

4. The method of claim 3, wherein the first end of each of at least two of the plurality of hold-ins is horizontally attached at substantially the same height to one another.

5. The method of claim 4, wherein after the first quantity of bulk material is placed into the container, the at least two of the plurality of hold-ins horizontally attached at substantially the same height, are extended from the side to which each hold-in is horizontally attached, towards the side which is opposite of the side to which each hold-in is horizontally attached.

6. The method of claim 5, wherein after the at least two hold-ins of the plurality of hold-ins which are horizontally attached at substantially the same height are extended, the second quantity of bulk material is placed into the container through its top opening.

7. The method of claim 3, wherein the height to which a second hold-in of the plurality of hold-in's first end is horizontally attached, is above the height to which a first hold-in of the plurality of hold-in's first end is horizontally attached.

8. The method of claim 7, wherein after the first quantity of bulk material is placed into the container, the first hold-in of the plurality of hold-ins is extended from the side of the plurality of sides to which it is horizontally attached, towards the side of the plurality of sides which is opposite of the side to which it is horizontally attached.

9. The method of claim 8, wherein after the first hold-in of the plurality of hold-ins is extended, this first hold-in of the plurality of hold-in's second end is at least partially secured in place before the second quantity of bulk material is placed into the container through the top opening.

10. The method of claim 7, wherein after the second quantity of bulk material has been placed into the container, the method further comprises:

extending the second hold-in of the plurality of hold-ins from the side of the plurality of sides to which its first end is horizontally attached, towards the side of the plurality of sides which is opposite of the one to which its first end is horizontally attached; and placing a third quantity of bulk material into the container through the top opening.

11. The method of claim 8, wherein after the first hold-in of the plurality of hold-ins is extended, the second quantity of bulk material is placed into the container through the top opening.

12. The method of claim 4, wherein a first hold-in of the at least two hold-ins horizontally attached at substantially the same height has its first end attached to a side of the plurality of sides which is different from a side of the plurality of sides to which a second hold-in of the at least two hold-ins horizontally attached at substantially the same height has its first end attached.

13. The method of claim 12, wherein after the first quantity of bulk material is placed into the container, the first hold-in of the at least two hold-ins horizontally attached at substantially the same height is extended from the side of the plurality of sides to which it is horizontally attached, towards the side of the plurality of sides which is opposite of the side to which it is horizontally attached; and the second hold-in of the at least two hold-ins horizontally attached at substantially the same height is extended from the side of the plurality of sides to which it is horizontally attached, towards the side of the plurality of sides which is opposite of the side to which it is horizontally attached.

14. The method of claim 13, wherein after the first hold-in and second hold-in of the at least two hold-ins horizontally attached at substantially the same height are extended, these hold-ins are attached to one another.

15. The method of claim 13, wherein after the first hold-in of the at least two hold-ins horizontally attached at substantially the same height is extended, this first hold-in of the at least two hold-in's second end is attached to at least one of the sides of the plurality of sides which is different from the side of the plurality of sides to which this first hold-in of the at least two hold-in's first end is horizontally attached; and wherein after the second hold-in of the at least two hold-ins horizontally attached at substantially the same height is extended, this second hold-in of the at least two hold-in's second end is attached to at least one of the sides of the plurality of sides which is different from the side of the plurality of sides to which this this second hold-in of the at least two hold-in's first end is horizontally attached.

16. A method of packaging bulk material, the method comprising:

providing a soft-sided container comprising:

a plurality of sides attached to a bottom, wherein each side of the plurality of sides has a corresponding height extending from the bottom towards a top opening defined in the container;

at least one closable top to open and close the top opening;

a first plurality of hold-ins, wherein each hold-in of the first plurality of hold-ins has:

a first end and a second end, the first end horizontally attached to a side of the plurality of sides at a location ranging from between 20 and 50 percent of the height of said side, the second end not initially secured, and the first end horizontally attached at substantially the same height as the first end of the other hold-ins of the first plurality of hold-ins; and a second plurality of hold-ins, wherein each hold-in of the second plurality of hold-ins has:

a first end and a second end, the first end horizontally attached to a side of the plurality of sides at a location ranging from between 50 and 80 percent of the height of said side, the second end not initially secured, and the first end horizontally at substantially at the same height as the first end of the other hold-ins of the second plurality of hold-ins;

placing a first quantity of bulk material into the container through the top opening, wherein this first quantity of bulk material only partially fills the container;

extending a first hold-in of the first plurality of hold-ins which are horizontally attached at substantially the same height, from the side of the plurality of sides to which it is horizontally attached towards a side of the plurality of sides which is opposite of the side of the plurality of sides to which it is horizontally attached, and extending a second hold-in of the first plurality of hold-ins which are horizontally attached at substantially the same height, from the side of the plurality of sides to which it is horizontally attached towards the a side of the plurality of sides which is opposite of the side to which it is horizontally attached;

placing a second quantity of bulk material into the container through the top opening;

extending a first hold-in of the second plurality of hold-ins which are horizontally attached at substantially the same height, from the side of the plurality of sides to which it is horizontally attached, towards a side of the plurality of sides which is opposite of the side to which it is horizontally attached, and extending a second hold-in of the second plurality of hold-ins which are horizontally attached at substantially the same height, from the side of the plurality of sides to which it is horizontally attached, towards a side of the plurality of sides which is opposite of the side to which it is horizontally attached; and placing a third quantity of bulk material into the container through its top opening.

17. The method of claim 16, wherein the container's side, to which the first of the first plurality of hold-ins which are horizontally attached at substantially the same height, is different from the side of the plurality of sides, to which the second of the first plurality of hold-ins which are horizontally attached at substantially the same height; and wherein the side of the plurality of sides, to which the first of the second plurality of hold-ins which are horizontally attached at substantially the same height, is different from the side of the plurality of sides, to which the second of the second plurality of hold-ins which are horizontally attached at substantially the same height.

* * * * *